United States Patent [19]

Giordano

[11] Patent Number: 4,648,640

[45] Date of Patent: Mar. 10, 1987

[54] LOCKABLE SLIDING GATE LATCHING DEVICE

[76] Inventor: Joseph F. Giordano, 8028 Oleander, Fontana, Calif. 92355

[21] Appl. No.: 754,540

[22] Filed: Jul. 15, 1985

Related U.S. Application Data

[62] Division of Ser. No. 508,009, Jun. 27, 1983, Pat. No. 4,536,022.

[51] Int. Cl.[4] ..... E05C 3/04

[52] U.S. Cl. ..... 292/228; 292/106

[58] Field of Search ..... 292/216, 207, 302, 304, 292/106, 129, 229, DIG. 46, 279; 70/97, 99, 100

[56] References Cited

U.S. PATENT DOCUMENTS

| | | | |
|---|---|---|---|
| 394,685 | 12/1888 | Fether | 292/216 X |
| 448,755 | 3/1891 | Tyler | 292/207 |
| 1,175,349 | 3/1916 | Fleming | 292/207 X |
| 3,040,555 | 6/1962 | Wartan | 292/106 X |
| 4,158,996 | 6/1979 | Marolic et al. | 292/207 X |
| 4,414,828 | 11/1983 | Takinami et al. | 292/216 X |

FOREIGN PATENT DOCUMENTS

| | | | |
|---|---|---|---|
| 1153573 | 9/1983 | Canada | 70/97 |

*Primary Examiner*—Richard E. Moore
*Attorney, Agent, or Firm*—Harvey S. Hertz

[57] ABSTRACT

A sliding gate latch device having concentric mutually slideable tubular members, an inner one mounted to the sliding gate and the other sliding thereover, the inner tubular member carrying an articulated jaw which engages a pin or bolt on a fixed structure to which the gate is closed. A combination lock is adapted to lock the tubular members together. A rotatable tongue also positions itself within the outer tubular member when the jaw is in the locked position to prevent opening when the tubular members are locked together.

4 Claims, 5 Drawing Figures

LOCKABLE SLIDING GATE LATCHING DEVICE

RELATION TO OTHER APPLICATIONS

This application is a division of copending U.S. patent application Ser. No. 06/508,009 filed June 27, 1983, now U.S. Pat. No. 4,536.022 entitled "Partically Secure Latch and Lock Device".

BACKGROUND OF THE INVENTION

1. Field of the Invention

The invention relates to latching and locking devices for sliding gates and the like, adapted for at least partial security 2. Description of the Prior Art In the prior art, locks and latches of many descriptions have evolved for use on doors, gates and the like. The degree of security justified in the design and application of such locks and latches is determined by the possible consequences of unauthorized or surreptitious entry.

A gate, for passage through a fence, for example, ordinarily does not justify a high order of entry security because an intruder may be able to simply scale the fence or gate or otherwise breach the barrier. An important degree of security against the casual intruder is often obtainable.

Typical of the state of the relevant prior art in latches and locks generally are U.S. Pat. Nos. 1,489,675; 3,206,954; 2,700,292; 4,179,143; 1,187,756; 2,671,683; 2,466,855; 3,692,342 and 3,709,538.

U.S. Pat. No. 1,489,675 shows the classical and ubiquitous spring door latch (key opened or locked).

U.S. Pat. No. 3,206,954 describes a variation of the classical spring latch door lock in which operation is by normal force (pull or push depending upon which door side the operator is positioned) rather than by door knob rotation.

U.S. Pat. No. 2,700,292 depicts another form of knob or handle operated, key-lockable, door latch assembly in which the latch member rotates in a plane parallel to the plane of the door and rides up, over and behind a sawtooth strike plate on a door frame in lieu of the usual horizontally translated latch member.

U.S. Pat. No. 4,179,143 shows a simple "barrel bolt" type of translating latch member with means for latching in the extended direction and quickly releasing for spring induced withdrawal.

A barn door spring latch mechanism without keying or other locking features is shown in U.S. Pat. No. 1,187,756. No security features are included.

U.S. Pat. No. 2,466,855 is a compressed-air operated lock for freight car doors intended for high order security against surreptitious entry by persons not equipped with the required compressed-air apparatus.

U.S. Pat. No. 3,692,342 is entitled "Container, Post Locking Member" but does not appear to be an operative latch or lock device. Rather, it is an assembly apparatus for a knock-down container on a pallet base structure such as used in commercial shipping.

U.S. Pat. No. 3,709,538 shows a device for securing a cover (hinged or otherwise) on a chest or receptacle with easy release. No security features are disclosed.

Another swinging gate latch is described in U.S. Pat. No. 2,671,683. No security features are contemplated and the operation is immediately obvious, even to a casual observer.

None of the aforementioned prior art disclosures address the requirement for any operatively non-obvious sliding gate latch device also capable of being simply locked for additional security.

The manner in which the invention deals with the inadequacies of the prior art to provide a relatively simple, but greatly improved, lockable latch device, for a sliding gate or the like; will be evident as this description proceeds.

SUMMARY OF THE INVENTION

In consideration of the aforementioned state of the prior art, it may be said to be the general object of the invention to provide a simple and inexpensive sliding gate latch with a non-obvious operating arrangement and with the capability of including a simple integral combination type lock for greater security.

The invention applies to a sliding gate which opens and closes by sliding substantially in the plane of the associated fence or barrier opening.

In the sliding gate arrangement, a pair of concentric tubular members are employed, one anchored on one end to the sliding gate and the other slideably fit over the anchored tubular member. A pin or bolt mounted on the fixed structure, adjacent to an end of the sliding gate when it is closed, is engaged by a slot in a jaw on the free end of the slideable tubular member and bears against a pivoted jaw portion rotating to a horizontal position a tongue which slips into the tubular members as the jaw closes and the gate is completely closed.

The device of the invention is adapted to the inclusion of an integral lock, such as a combination lock which extends a locking pin (the locked position) into a part of the mechanism to prevent release of the latching mechanism until the lock is operated to disengage the locking pin.

The detailed structure and operation of the embodiments will be understood as this specification continues.

DETAILED DESCRIPTION

Figure 1:
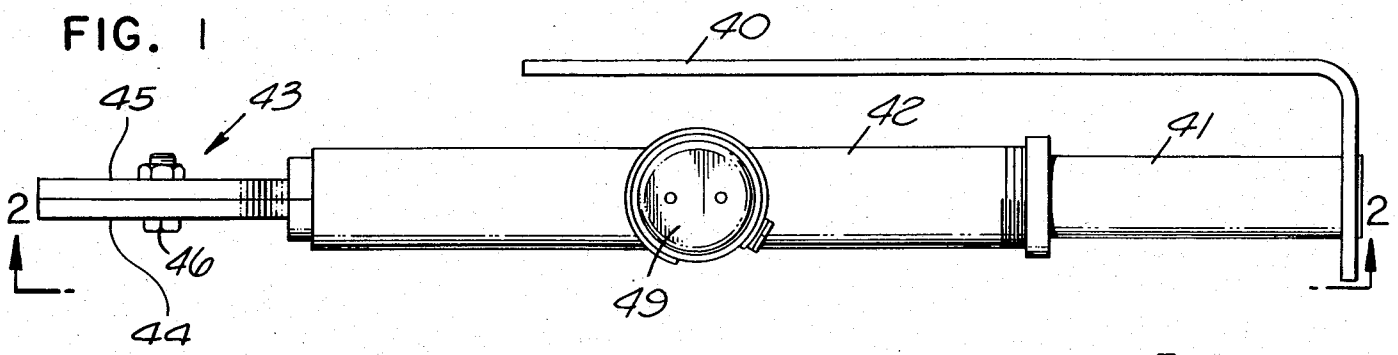
FIG. 1 is an overall plan view of a typical emodiment of the invention adapted for a sliding gate.

Referring now to FIGS. 1 through 4, the sliding gate embodiment will be described. In FIG. 1 the mechanism is preferably mounted by means of a bracket 40 onto the sliding gate. Parts 41 and 42 are the inner and outer tubular members, respectively, part 42 being slideable over part 41.

Figure 2:
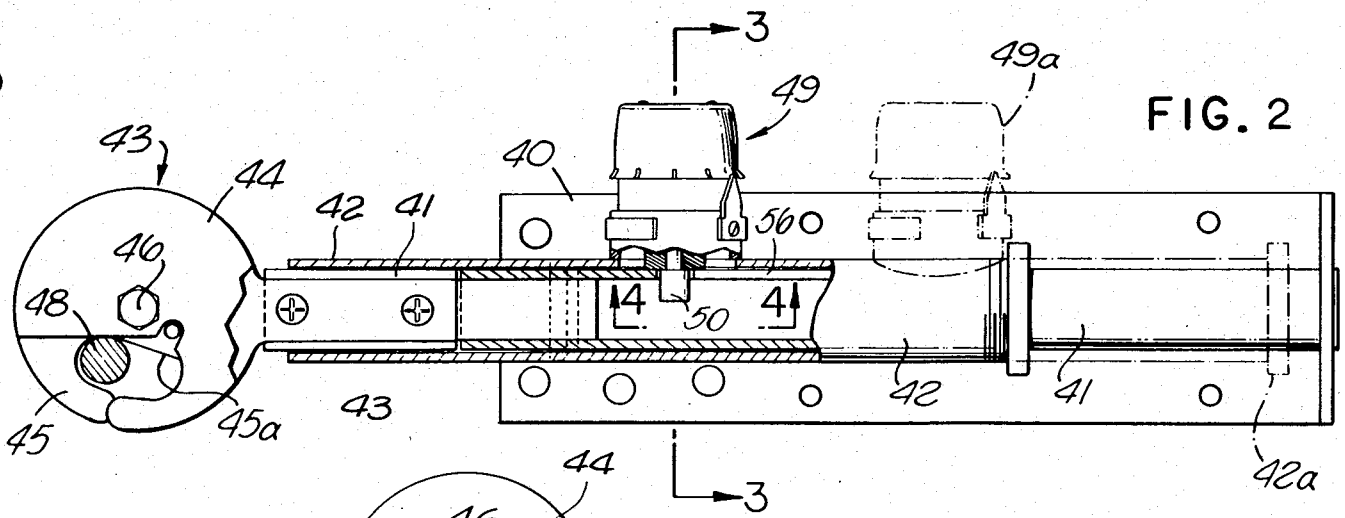
FIG. 2 is a partial cut-away view of the mechanism taken along 2—2 as indicated in FIG. 1.
Figure 3:
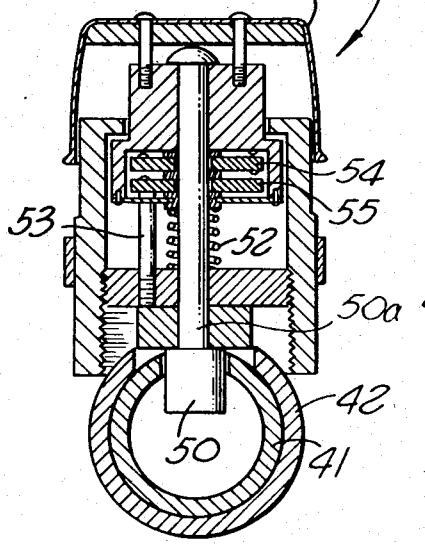
FIG. 3 is a sectional view of the combination lock taken along line 3—3 as indicated in FIG. 2.

In the "gate open" position, the conventional combination lock 49 is constructed such that a locking plunger 50 is pushed downward to clear as the cap 51 is pushed downward (see FIGS. 2 and 3). Plunger 50 passes through and clears lateral holes in tubular members 41 and 42 which match when the assembly is in the "gate locked" position. In the "gate open" position, the combination lock assembly assumes position **49*a* as the tubular member 42 is slid to position 42*a*. When locked, the plunger 50 is engaged through lateral holes in 41 and 42 and the cap 51 is "popped up" by spring 52**.

Figure 5:
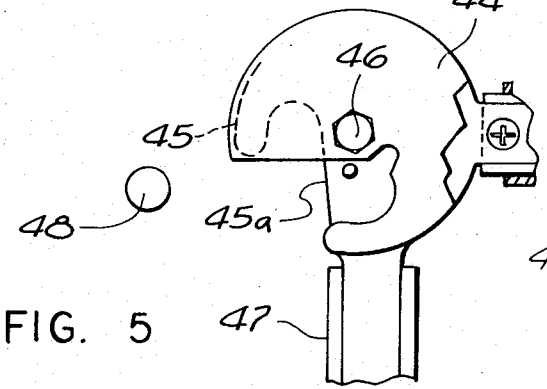
FIG. 5 shows the device of FIG. 2 in the unlatched (gate open) condition.

A bolt or pin 48 will be understood to project from the fixed structure of the fence or barrier, oriented to be gripped by the jaw part 45. As the gate is translated toward closure, jaw member 44 (fixed to inner tubular member 41) slides over this bolt or pin 48 as shown in FIG. 2, and by bearing against latching surface 45*a*, pin 48 causes rotatable jaw member 45 to rotate about 46 to effect closure of the jaw assembly 43 as shown in FIG. 2. The tongue 47 is illustrated in the "jaws open" position in FIG. 5. However, tongue 47 is rotated upward to a position where outer tubular member 42 slides thereover, in the "gate locked" position of pin 48 vis-a-vis closed jaws 44 and 45 as shown in FIG. 2.

Figure 4:
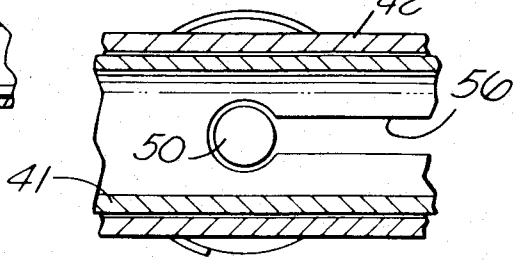
FIG. 4 is a further section taken along line 4—4 as indicated on FIG. 2.

The combination lock 49 is, per se, conventional. The spindle 53 (FIG. 3) engages openings in the disks 54 and 55 during operation. FIG. 4 shows the engagement of pin 50 from inside the assembly as indicated on FIG. 2. In the unlocked position, the stem 50*a* does not prevent the outer tubular member 42 from sliding over the inner tubular member 41 but rather, the stem 50*a* lowers 50 into the interior of 41 and 50*a* and stem 50*a* clears within slot 56 (see FIG. 4). The parts of FIG. 3 and FIG. 4 are illustrated in the locked position.

Modifications and variations within the spirit of the invention are obviously possible and accordingly, it is not intended that the invention should be regarded as limited to the structure and features shown as described. The drawings and this description are intended to be typical and illustrative only.

I claim:

1. An elongated, lockable, latch device for a sliding gate associated with an opening in a fence or the like, said opening being bounded by a fixed structural member at one lateral edge thereof forming a closure interface with the corresponding edge of said sliding gate, said latch device being operable to effect latching of said gate at said interface, comprising:

a first generally tubular member mounted adjacent a first end thereof from a fixed location on said gate at least partially backset from said interface to project the second end of said first tubular member toward said interface;

a jaw assembly mounted on said first tubular member second end and a pin associated with said fixed structural member, said jaw assembly including a first jaw member having a mouth open toward said pin when said gate is open;

latching means including a second jaw member rotatably attached to said first jaw member, said second jaw member including a tongue projecting downward at an angle with respect to the centerline of said first tubular member when said jaw assembly is open, said second jaw member including a portion responsive to pressure from said pin as said gate is translated to closure at said interface to rotate said second jaw member to grip and capture said pin and contemporaneously rotate said tongue to project parallel to said first turbular member centerline; and including a second tubular member having an inside cross-section larger than the outside cross-section of said first tubular member, said second tubular member being slideably placed over said first tubular member to slide over said tongue when said gate is closed, thereby to prevent opening of said jaw assembly.

2. The combination according to claim 1 in which said first and second tubular members are of substantially circular cross-section.

3. The combination according to claim 1 in which axially and radially matching holes are provided radially through the wall thicknesses of said tubular members and locking means are included for inserting a cylindrical plunger through said holes to lock said second tubular member in place, said plunger having a stem portion of smaller diameter than said cylindrical plunger and said radial hole through the wall thickness of said first tubular member is extended into an axial slot through said wall thickness, said slot having a width greater than the diameter of said stem, but less than the diameter of said cylindrical plunger, said locking means being also adapted to lower said plunger into the interior of said first tubular member to permit sliding of said second tubular member with said stem traversing within said slot to release said tongue and thereby permitting opening of said jaw assembly.

4. The combination according to claim 3 in which said locking means comprises a combination lock controlling said stem and plunger downward to release the locking action between said tubular members and relatively upward to effect locking of said tubular members together.

* * * * *